United States Patent [19]

Banfi

[11] Patent Number: 4,695,690

[45] Date of Patent: Sep. 22, 1987

[54] CLOSING DELAY ARRANGEMENT FOR CURRENT LIMITING CIRCUIT BREAKER CONTACTS

[75] Inventor: Claudio Banfi, Rovello Porro, Italy

[73] Assignee: General Electric Company, New York, N.Y.

[21] Appl. No.: 820,051

[22] Filed: Jan. 21, 1986

[51] Int. Cl.[4] ..... H01H 33/18

[52] U.S. Cl. ..... 200/147 R

[58] Field of Search ..... 200/147 R

*Primary Examiner*—Robert S. Macon

*Attorney, Agent, or Firm*—Richard A. Menelly; Walter C. Bernkopf; Fred Jacob

[57] ABSTRACT

A control arrangement to prevent or delay the closing of current limiting circuit breaker contacts after opening by repulsion due to a short circuit is disclosed. A first contact arm and a second contact arm are operatively associated with a ratchet or pawl for locking the second contact arm. A release lever operatable by the first contact arm and the breaker operating mechanism releases the ratchet after a delay period greater than the duration of the short circuit or the operating time of the breaker operating mechanism.

7 Claims, 3 Drawing Figures

CLOSING DELAY ARRANGEMENT FOR CURRENT LIMITING CIRCUIT BREAKER CONTACTS

BACKGROUND OF THE INVENTION

The invention relates to a device for preventing the transitory reclosing of the contacts of a current limiting circuit breaker after opening by electrodynamic repulsion caused by a short circuit current before the current is extinguished. Interruption of the short circuit current can be due to two distinct causes: namely, a transitory rapid contact separation, or by the positive operation of the circuit breaker trip mechanism to hold the contacts open indefinitely.

In current limiting circuit breakers, the two arms bearing the contacts are free to separate due to electrodynamic repulsion under intense short circuit currents. Opening of the contacts is subsequently completed by the circuit breaker operating mechanism, if the short circuit current is maintained for a time sufficiently long enough to articulate the operating mechanism.

The high separation speed of the contacts necessary to provide the current limitation can result in a rebound of the contacts upon separation resulting in a transitory reclosing of the contacts before the operating mechanism has had sufficient time to operate. When the short circuit occurrence is shorter than the response time of the operating mechanism, there is no need to open the contacts indefinitely. It is important however, to ensure continuity of circuit current in the absence of a real fault condition. With 3-phase loads protected by 3-pole breakers, it is essential to prevent a single-phase transitory short circuit occurrence from opening only one pole of the breaker, resulting in a dangerous condition known as "single phasing".

The purpose of this invention is to delay reclosing of the circuit breaker contacts, after a short circuit interruption, for a period of time sufficient to allow the operating mechanism to open the contacts indefinitely providing the short circuit lasts for a time longer than the delay.

SUMMARY OF THE INVENTION

The invention consists essentially of a contact delay arrangement wherein a first contact arm bearing a first contact and a second contact arm bearing a second contact are both free to rotate around their respective pivot pins. The first pivot pin is connected to the contact arm support cam which is operated by the circuit breaker operating mechanism and the second pivot pin is housed in the contact arm support. The contacts are held closed by a pair of springs and are separated by means of electrodynamic repulsion upon the occurrence of a short circuit. The delay arrangement includes a spring-loaded pawl locking the second contact arm by engaging a pawl pin attached to the second contact arm when the arm is driven by electromagnetic repulsion toward a stop to prevent the arm from returning to a closed position after striking against the stop. A release lever is operated either by a post attached to the first contact arm when the first arm moves toward its closed position or by a rear surface of the support cam driven by the circuit breaker operating mechanism. When the support cam moves the first contact arm to the open position it drives the bottom bumper of the release lever against a pin extending through the bottom of the spring-loaded pawl moving the pawl out of engagement with the pawl pin thereby allowing the second contact arm to return to its initial position.

The release lever is pivotally supported by a pair of pins carried by a pair of sockets formed in the insulating hood that surrounds both the contact arm support as well as part of the second arm. The top bumper of the release lever is in the nature of a reinforced upper extension designed to receive a post attached to the first contact arm or the rear surface of the cam upon operation of the breaker operating mechanism. The bottom bumper comprises a reinforced lower extension designed to contact the pawl pin to release the pawl thereby unlocking the second contact arm.

BRIEF DESCRIPTION OF THE DRAWINGS

These and other objects and advantages will be made clear by the following detailed description of the invention accompanied by the annexed drawings wherein.

DESCRIPTION OF THE PREFERRED EMBODIMENT

Figure 1:
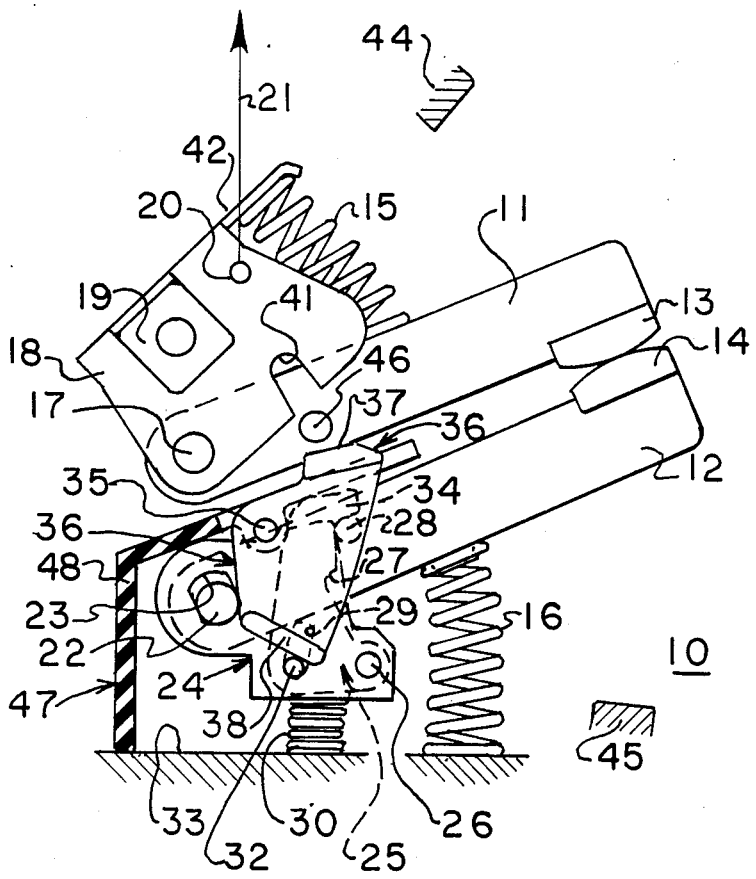
FIG. 1 is a side view in partial section of the delay arrangement of the invention applied to a pair of circuit breaker contacts in a closed condition.

The delay arrangement 10 is shown in FIG. 1 with a contact arm 11 and a contact arm 12 carrying contacts 13, 14 held in a closed position by springs 15 and 16 respectively. The contact arm 11 rotates about a pin 17 supported by an operating cam 18 which, in turn, rotates around an operating shaft 19 fitted with a post 20 to which a force represented by arrow 21 is applied when it is desired to cause cam 18 to rotate around the operating shaft 19 to move contact arm 11 into the fully open position shown in FIG. 3.

The contact arm 12 rotates around a pin 22 captured within an elongated slot 23 formed in a contact arm support 24. Also mounted on the contact arm support is a pawl 25, one on each side of the contact arm, only one of which is shown for purposes of clarity. The pawl rotates around a pin 26 through the contact arm support and has a detent 27 formed at the end opposite pin 26 which engages a post 28 attached to the contact arm 12. A pin 32 attached to the bottom of the pawl 25 is captured within a radial slot 29 formed in the side of the support 24 and is biased upwards within the slot by a compression spring 30 which is captured between the pin 32 and a bottom circuit breaker support 33. Projection 34 is formed on each side of the contact arm support 24 for engaging the post 28 on contact arm 12 to stop movement of the arm against the bias exerted by the spring 16.

Figure 2:
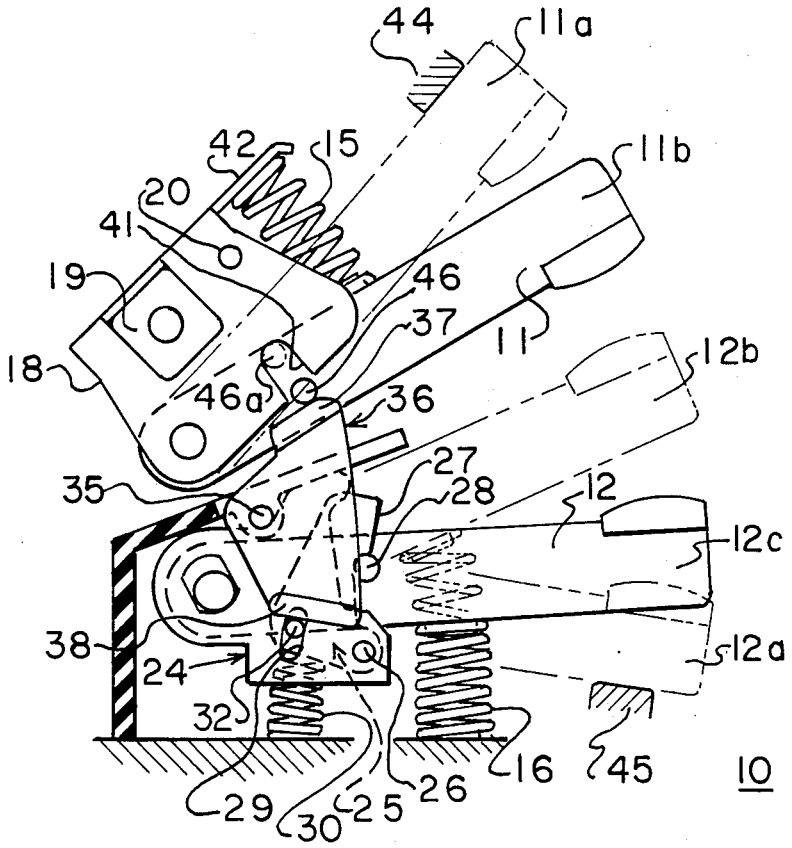
FIG. 2 is a side view of the arrangement of FIG. 1 with the pair of contacts opened by repulsion due to a short circuit.
Figure 3:
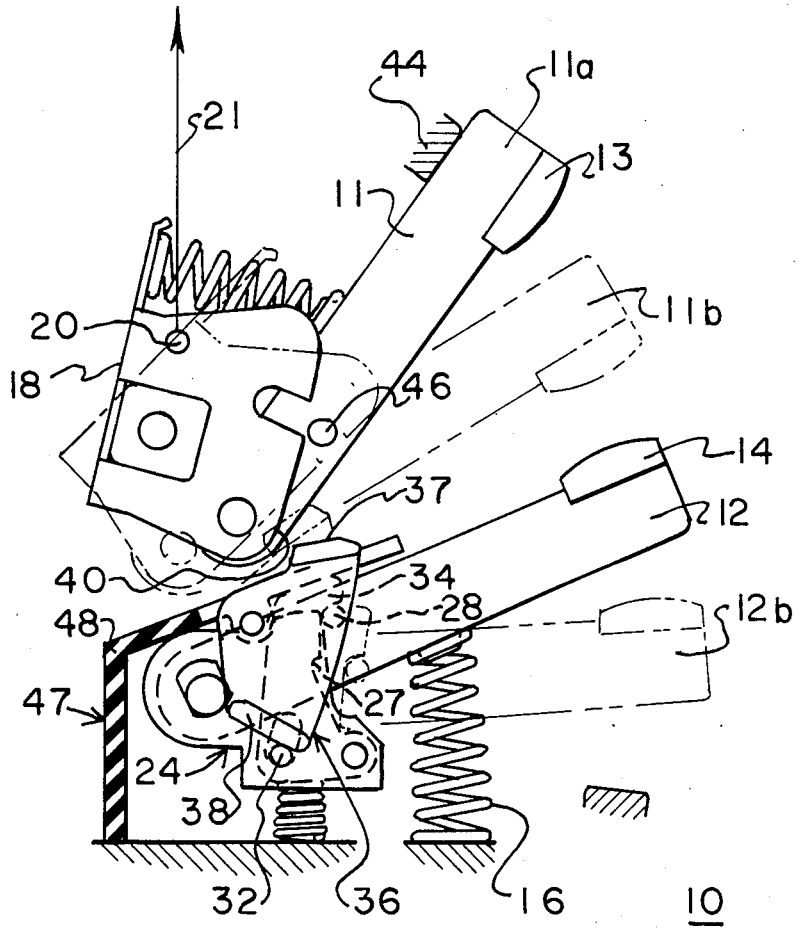
FIG. 3 is a side view of the arrangement of FIG. 1 the pair of contacts opened by means of the operating mechanism.

The entire contact arm support 24 is enclosed within an insulating hood 47 fitted with a cover 48. The cover is provided with a hole on either side of the contact arm to receive a pair of pins 35 formed on the exterior surface of a pair of operating levers 36. One lever is arranged on each side of the contact arm and both levers are provided with top and bottom reinforced bumpers 37, 38. The reinforced bumpers are engaged by a post 46 extending from both sides of contact arm 11 as shown in FIG. 2 or by the rear surface 40 of the cam 18 as shown in FIG. 3.

Referring back to FIG. 2 the cam 18 has a notch 41 formed on a bottom surface for receiving the post 46, as indicated in phantom at 46*a*, during opening of the contact arm under repulsion due to short circuit current as indicated in phantom at 11*a*. An extension 42 on the top of cam 18 serves as a support for the spring 15 which is associated with contact arm 11.

A pair of stops 44, 45 limit the travel of the contact arms 11 and 12, respectively. When subjected to repulsion force due to short circuit current, the contact arms 11, 12 move into the positions indicated in phantom as 11*a* and 12*a*, respectively.

The operation of the instant invention can be seen by referring back to FIG. 1 wherein the contacts 13, 14 are shown in a closed position. The spring 15 biases contact arm 11 in a clockwise direction whereas the spring 16 biases contact arm 12 in a counter-clockwise direction to hold the respective contacts in counter-balanced relation to each other.

When the current is sufficiently intense, such as upon the occurrence of a short circuit, the contact arms 11 and 12 are pushed apart by electrodynamic forces and move to positions 11*a* and 12*a*, indicated in phantom in FIG. 2, where they strike against their respective stops 44 and 45 and rebound away from them.

When contact arm 12 is repulsed into position 12*a* the attached post 28 slides under detent 27 thereby causing pawl 25 under the urgence of compression spring 30 to rotate clockwise about pin 26 as indicated. Contact arm 12, after reaching position 12*a*, rebounds away from stop 45 and returns in a counter-clockwise direction under the urgence of spring 16 to the position shown at 12*c* and is held from further motion by the trapment of post 28 under detent 27.

The clockwise rotation of pawl 25 has moved pin 32 upwards within the radial slot 29 striking the bottom reinforced bumper 38 causing lever 36 to rotate counterclockwise about pin 35 to the position shown in FIG. 2. With lever 36 and pawl 25 in the indicated positions, the following events are now provided for. Should the overcurrent condition cease before the circuit breaker operating mechanism responds, cam 18 is not acted upon by the operating mechanism. Contact arm 11, after striking from stop 44 as indicated in phantom at 11*a*, is urged by spring 15 in the clockwise direction until post 46 strikes the top reinforced bumper 37 driving lever 36 clockwise about pin 35 which in turn drives the bottom reinforced bumper 38 into contact with pin 32. Pin 32 is driven downwards within slot 29 forcing pawl 25 to rotate counter-clockwise against the urgence of compression spring 30, releasing post 28 from under detent 27. Contact arm 12 is returned to the original position shown in FIG. 1 under the urgence of spring 16 while contact arm 11 returns to its original position under the urgence of spring 15 to result in the closed condition of contacts 13, 14. The time elapsed between the separation of the contacts from the open position in FIG. 2 to their subsequent return to the closed position shown in FIG. 1 is sufficient to transfer the arc formed between the contacts 13 and 14 to an arc chamber (not shown) for extinction. Extinction of the arm and reclosing of the contacts returns the circuit breaker to normal operation after the circuit current has been interrupted by the fast repulsion of the contacts.

Should the overcurrent persist long enough for the breaker operating mechanism to respond, as represented by the force arrow 21 applied to post 20 as shown in FIG. 3, cam 18 is rotated counter-clockwise bringing its rear surface 40 against the top reinforced bumper 37 thereby driving the lever 36 clockwise and bringing the bottom reinforced bumper 38 against pin 32 and releasing post 28 from under detent 27. Contact arm 12 returns from position 12b to the initial position shown in FIGS. 1 and 3 under the urgence of spring 16. Contact arm 11 is carried by the action of the circuit breaker operating mechanism on cam 18 from the position indicated in phantom at 11b up to the position against stop indicated in solid lines at 11*a* which is the fully opened position of contact 13.

It is thus seen that the arrangement of the pivotally arranged lever and spring-loaded pawl provide a sufficient delay to the closing of the circuit breaker contacts after short circuit repulsion to thereby prevent deleterious reclosing and single phasing conditions.

Having described my invention, what I claim as new and desire to secure by Letters Patent is:

1. A closing delay arrangement for circuit breaker contacts comprising:

a first movable contact arm having a first contact and a second movable contact arm having a second contact said first and second movable contact arms being arranged for electrodynamic repulsion upon the occurrence of short circuit current through said contacts and being biased toward each other by a pair of opposedly arranged contact springs, said first contact arm being pivotally attached to a first support means under control of a circuit breaker operating mechanism for moving said first contact arm between a closed and a fully open position, said first contact arm being moved to a partially open position by means of electrodynamic repulsion between said first and second contact arms independent of said circuit breaker operating mechanism, said second arm being pivotally attached to a second support means for movement between first and second positions; and a pawl pivotally attached to said second support means, and being biased to a first position for holding said second contact arm in said first position for holding said second contact arm in said first position whereby a detent on said pawl captures a post on said second contact arm to hold said second contact arm in said first position, said second contact arm being moved to said second position by said circuit breaker operating mechanism when said post is released from said detent.

2. The closing delay arrangement of claim 1 wherein said pawl is pivotally attached to said second support means by a pin on a bottom of said pawl captured within a slot formed within said second support means.

3. The closing delay arrangement of claim 2 wherein said detent is moved away from said post by sliding said pin downwards in said slot.

4. The closing delay arrangement of claim 3 further including a lever pivotally arranged on said second support means and having a top bumper on a top surface receiving a post on said first contact arm when said first contact arm rotates in a clockwise direction and a bottom bumper on a bottom surface thereof contacting said pin on said pawl thereby moving said pin downward within said slot.

5. The closing delay arrangement of claim 1 further including projection means formed on said support means for receiving said second contact arm post during counterclockwise motion of said second contact arm and limiting travel of said second contact arm to said second position.

6. The closing delay arrangement of claim 4 wherein said lever is pivotally attached to an insulative housing arranged over said said support means.

7. The closing delay arrangement of claim 1 wherein said pawl holds said second contact arm in said first position for a period of time longer than the response time of said circuit breaker operating mechanism.

* * * * *